US010962225B2

(12) United States Patent
Patil et al.

(10) Patent No.: US 10,962,225 B2
(45) Date of Patent: Mar. 30, 2021

(54) ROTARY ADJUSTABLE NECK FOR GAS VENT CAP

(71) Applicant: CARDINAL IP HOLDING, LLC, Milwaukee, WI (US)

(72) Inventors: Vikas A. Patil, Jaysingpur (IN); Vijay Singh Choudhary, Jodhpur (IN); Rajesh D. Vyas, Vadodara (IN); Anup T. Kole, Dudhgaon (IN); A K S Manian, Chennai (IN)

(73) Assignee: Cardinal IP Holding, LLC, Milwaukee, WI (US)

( * ) Notice: Subject to any disclaimer, the term of this patent is extended or adjusted under 35 U.S.C. 154(b) by 170 days.

(21) Appl. No.: 16/119,882

(22) Filed: Aug. 31, 2018

(65) Prior Publication Data

US 2020/0063958 A1 Feb. 27, 2020

Related U.S. Application Data

(60) Provisional application No. 62/722,413, filed on Aug. 24, 2018.

(51) Int. Cl.
*F23J 13/08* (2006.01)

(52) U.S. Cl.
CPC ..... *F23J 13/08* (2013.01); *F23J 2213/50* (2013.01)

(58) Field of Classification Search
CPC ..... F23L 17/12; F23J 13/08; F23J 2213/50
USPC ..... 454/35
See application file for complete search history.

(56) References Cited

U.S. PATENT DOCUMENTS

| | | | |
|---|---|---|---|
| 3,049,068 | A | 8/1962 | Rousey |
| 4,777,871 | A | 10/1988 | Stowell |
| 5,988,977 | A | 11/1999 | Gallagher et al. |
| 6,852,023 | B2 | 2/2005 | Hediger et al. |
| 8,246,430 | B1 | 8/2012 | Paynton et al. |
| 2006/0249142 | A1 | 11/2006 | Bibaud et al. |

FOREIGN PATENT DOCUMENTS

| | | |
|---|---|---|
| EP | 3263988 | 1/2018 |
| FR | 2796451 | 1/2001 |

*Primary Examiner* — Steven B McAllister
*Assistant Examiner* — Allen R Schult
(74) *Attorney, Agent, or Firm* — Warner Norcross + Judd LLP

(57) ABSTRACT

An adjustable neck for a vent cap includes a housing having a mount and a cylindrical body, where the cylindrical body includes an inner surface. The adjustable neck also includes adjustable straps arranged to form an adjustable inner diametrical surface disposed radially inward from the cylindrical body of the housing, relative to a central axis of the adjustable neck. The adjustable inner diametrical surface is configured to engage an outer pipe surface. The adjustable straps are coupled to the inner surface of the cylindrical body. The adjustable neck also includes legs coupled to the adjustable straps and to the mount, where the cylindrical body is configured to be rotated relative to the mount and the legs to adjust a dimension of the adjustable inner diametrical surface to correspond to the outer pipe surface.

24 Claims, 8 Drawing Sheets

FIG. 8A
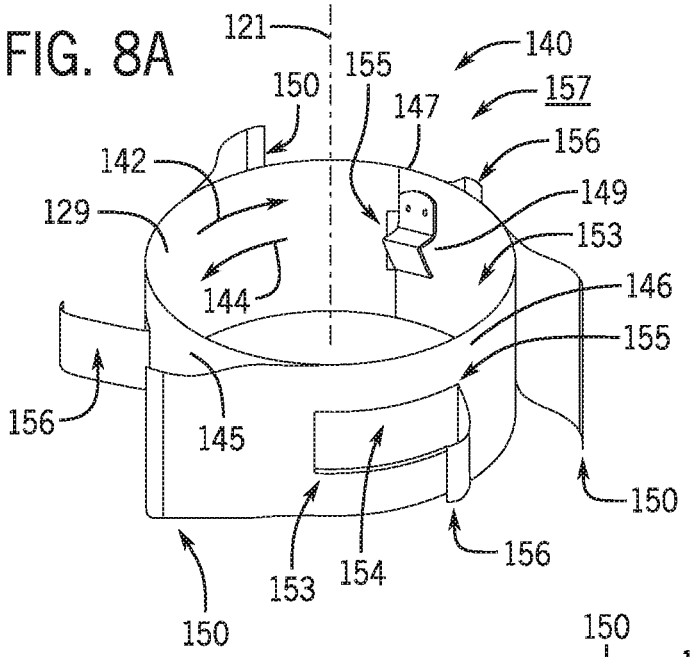
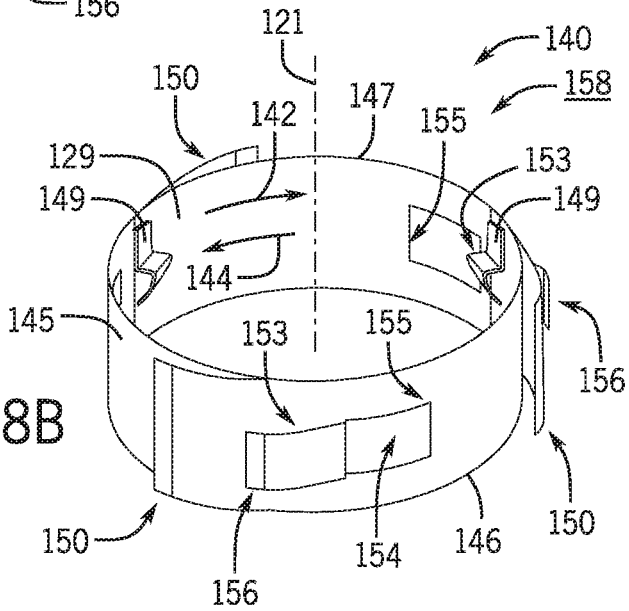
FIG. 8B
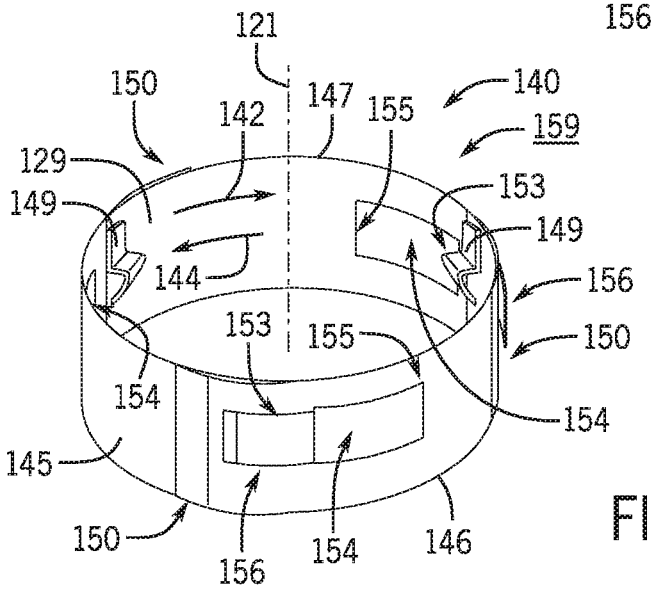
FIG. 8C

ROTARY ADJUSTABLE NECK FOR GAS VENT CAP

CROSS REFERENCE TO RELATED APPLICATIONS

This application claims priority from and the benefit of U.S. Provisional Application Ser. No. 62/722,413, entitled "ROTARY ADJUSTABLE NECK FOR GAS VENT CAP," filed Aug. 24, 2018, which is hereby incorporated by reference in its entirety for all purposes.

BACKGROUND

The present disclosure relates generally to heating, ventilation, and air conditioning (HVAC) systems and, more particularly, to vent caps of HVAC systems.

A wide range of applications exists for HVAC systems. For example, residential, light commercial, commercial, and industrial systems are used to control temperatures and air quality in residences and buildings. In certain HVAC systems or components thereof, such as a furnace, hot combustion gases may be generated by combusting an air-fuel mixture in a combustion chamber or burner of the furnace. The hot combustion gases may be passed through a heat exchange coil, and a fan or blower may urge an air flow over the heat exchange coil. The air flow may extract heat from the hot combustion gases passing through the heat exchange coil, and the heated air flow may be utilized to heat a space.

A vent pipe of the HVAC system may route the used combustion gases to an environment external to the building or residence. Unfortunately, traditional vent caps configured to protect the HVAC system by blocking moisture, such as rain, from entering the vent pipe are difficult to install, expensive, and often incompatible with certain pipes. Accordingly, improved vent caps for vent pipes of HVAC systems are desired.

SUMMARY

The present disclosure relates to an adjustable neck for a vent cap. The adjustable neck includes a housing having a mount and a cylindrical body, where the cylindrical body includes an inner surface. The adjustable neck also includes adjustable straps arranged to form an adjustable inner diametrical surface disposed radially inward from the cylindrical body of the housing, relative to a central axis of the adjustable neck. The adjustable inner diametrical surface is configured to engage an outer pipe surface. The adjustable straps are coupled to the inner surface of the cylindrical body. The adjustable neck also includes legs coupled to the adjustable straps and to the mount. The cylindrical body is configured to be rotated relative to the mount and the legs coupled to the mount to adjust a dimension of the adjustable inner diametrical surface to correspond to the outer pipe surface.

The present disclosure also relates to a vent cap assembly for coupling to an outer pipe surface. The vent cap assembly includes a vent cap and a rotary adjustable neck. The rotary adjustable neck includes a mount coupled to the vent cap, a cylindrical body rotatable relative to the mount, adjustable straps arranged within the cylindrical body to form an adjustable inner diametrical surface configured to engage the outer pipe surface to couple the vent cap assembly thereto, and legs arranged within the cylindrical body and coupled to the mount and to adjustable straps. The cylindrical body is configured to be rotated in a circumferential direction about a central axis of the adjustable neck to adjust a dimension of the adjustable inner diametrical surface such that the dimension is corresponds to the outer pipe surface.

The present disclosure also relates to an adjustable neck for a vent cap. The adjustable neck includes a housing having a cylindrical body having a surface. The adjustable neck also includes an adjustable strap system. The adjustable strap system is disposed within the housing and includes a first adjustable strap coupled to the surface of the cylindrical body, a second adjustable strap coupled to the surface of the cylindrical body, and a third adjustable strap coupled to the surface of the cylindrical body. The first adjustable strap, the second adjustable strap, and the third adjustable strap are joined with one another to form an adjustable inner diametrical surface. The adjustable neck also includes a first leg coupled to the first adjustable strap, a second leg coupled to the second adjustable strap, and a third leg coupled to the third adjustable strap. Movement of the cylindrical body in a first circumferential direction relative to the first leg, the second leg, and the third leg causes a dimension of the adjustable inner diametrical surface formed by the adjustable strap system to increase, and movement of the cylindrical body in a second circumferential direction opposite to the first circumferential direction causes the dimension of the adjustable inner diametrical surface formed by the adjustable strap system to decrease.

DRAWINGS

FIGS. 8A-8C are perspective views illustrating three different positions of an embodiment of a strap system of the adjustable neck of FIG. 6, utilizing the three adjustable straps of FIG. 7, in accordance with embodiments described herein;

DETAILED DESCRIPTION

Figure 1:
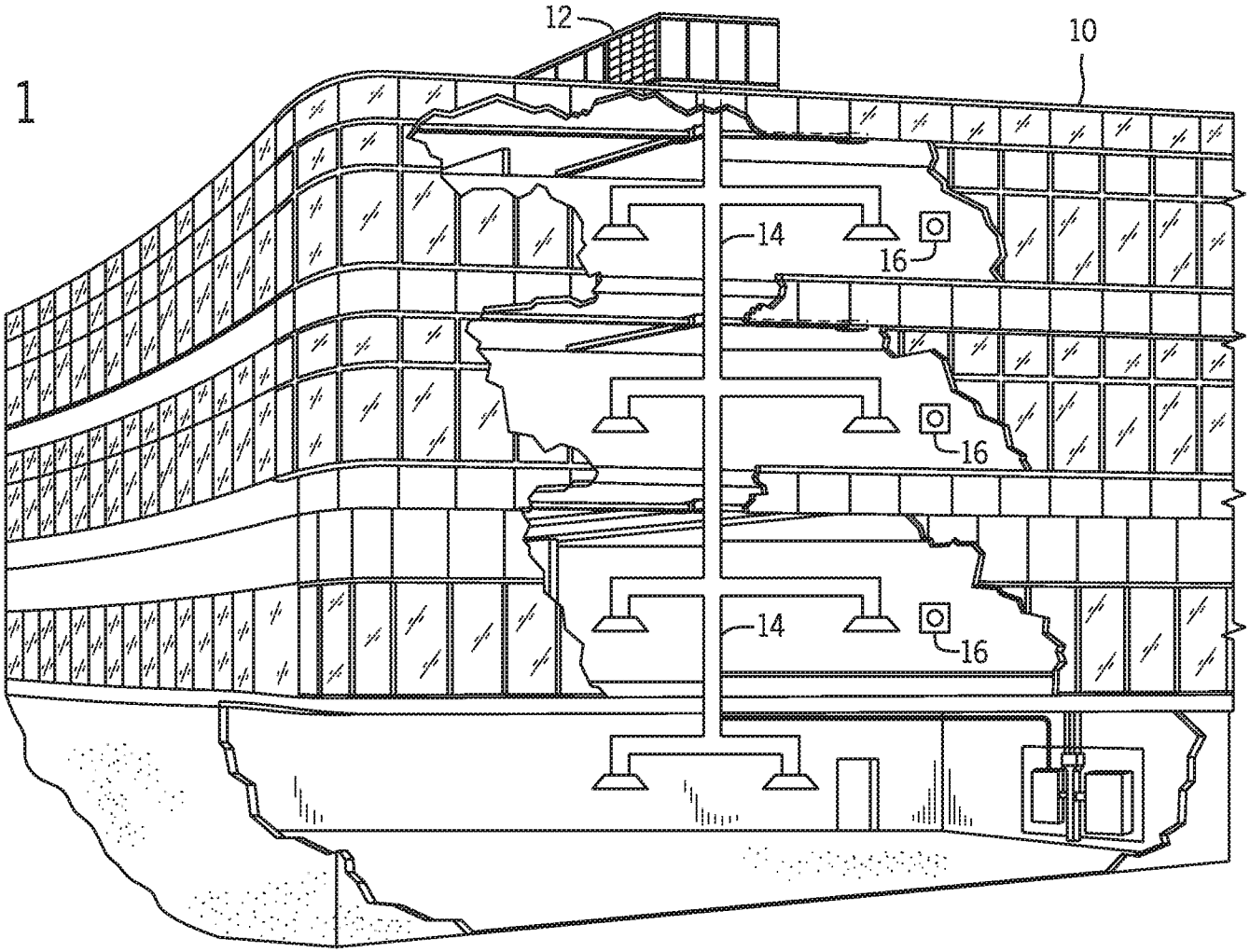
FIG. 1 is a perspective view of a heating, ventilation, and air conditioning (HVAC) system for building environmental management, in accordance with embodiments described herein.

The present disclosure is directed toward heating, ventilation, and air conditioning (HVAC) systems and, more particularly, toward vent caps of HVAC systems.

A wide range of applications exists for HVAC systems. For example, residential, light commercial, commercial, and industrial systems are used to control temperatures and air quality in residences and buildings. In certain HVAC systems or components thereof, such as a furnace, hot combustion gases may be generated by combusting an air-fuel mixture in a combustion chamber. The hot combustion gases may be passed through a heat exchange coil, and a fan or blower may urge an air flow over the heat exchange coil. The air flow may extract heat from the hot combustion gases passing through the heat exchange coil, and the heated air flow may be utilized to heat a space. A vent pipe of the furnace may route the used combustion gases to an environment external to the building or residence. Vent pipes may also be utilized in HVAC systems other than the above-described furnace.

In order to protect the HVAC system from moisture/liquid contact, such as water impact from rain exposure, vent pipes include a vent cap disposed thereon. Vent pipes in different buildings, residences, or other structures may vary in size. Traditional vent caps may not be suited for installation, or for quick installation, on differently sized vent pipes. For example, a traditional rain cap sized to fit a vent pipe having a particular outer diameter may be difficult to adjust to, or may be incompatible with, a different vent pipe having a different outer diameter.

In accordance with present embodiments, a vent cap assembly for a vent pipe of an HVAC system may include a vent cap and an adjustable neck for the vent cap. The adjustable neck may be configured to be adjusted to fit the vent cap assembly onto different vent pipes having outer diameters of different sizes. For example, the adjustable neck may include a housing having a mount configured to be coupled to the vent cap, and a cylindrical body disposed underneath the mount and configured to house components coupled to the mount. That is, the cylindrical body may include components housed therein that are adjustable to change a fitting of the adjustable neck of the vent cap assembly, as described above. Certain of the adjustable components disposed radially inward from the cylindrical body may be coupled, such as welded, to the mount. Further, in some embodiments, the cylindrical body may be referred to as an actuator and, when turned in circumferential directions relative to the mount, may cause adjustment of the components disposed radially inward from the cylindrical body, said components being coupled to the mount.

For example, a strap system of the adjustable neck, which utilizes two or more adjustable straps, may be disposed within, or radially inward from, the cylindrical body of the housing of the adjustable neck. The straps may be linked back-to-front in a ring or loop configuration to form an inner diametrical surface configured to engage an outer diameter of the vent pipe. To facilitate formation of the inner diametrical surface, each strap of the strap system may include a hook end and a window end. The window end of each strap may include an opening, or "window," and the hook end of each strap may include a hook extending therefrom. The hook of each strap is configured to engage, or extend through, the window of another, adjacent strap, and the hooks may be attached or coupled to an inner surface of the cylindrical body. For example, a first strap may include a first window and a first hook. The first hook of the first strap may extend through a second window of a second strap, and the first hook may be coupled to the inner surface of the cylindrical body. A second hook of the second strap may extend through a third window of a third strap, and the second hook may be coupled to the inner surface of the cylindrical body. A third hook of the third strap may extend through the first window of the first strap to complete the loop, and the third hook may be coupled to the inner surface of the cylindrical body. The first, second, and third straps may be curved such that each strap forms approximately 120 degrees of the above-described inner diametrical surface.

Each window may form a rectangular cutout in the corresponding strap. The hook of the adjacent strap engaging the window is movable relative to the window in circumferential directions with respect to a central axis of the vent cap assembly. That is, since the hook of one strap extends through the window of another strap, and the window includes a circumferential dimension extending along the corresponding strap, the hook and the window can slide relative to each other in circumferential directions along the circumferential dimension. In some embodiments, as described above, the hooks may be rigidly coupled to the inner surface of a wall of the cylindrical body of the housing. As the cylindrical body, or "actuator," is turned relative to the mount, the cylindrical body moves the hooks attached to the cylindrical body. Additionally, the window ends of the straps may be directly or indirectly coupled to the mount, for example via corresponding legs extending between the window ends of the straps and the mount, such that window ends of the straps are held stationary as the cylindrical body and hook ends of the straps are actuated in a circumferential direction.

For example, the legs may engage the window ends of the straps and the mount. As the hooks of the straps are moved by the actuator, the legs and corresponding window ends of the straps are held stationary via attachment to the mount. This configuration causes a change to the dimension of the inner diametrical surface formed by the adjustable strap system. It should be noted that the cylindrical body, sometimes referred to as the "actuator," may be accessible by an operator. Accordingly, the strap system can be manipulated, via the cylindrical body or "actuator," to increase or decrease a size of the inner diametrical surface to correspond to, for example, the outer diameter of the vent pipe. In this manner, the operator may adjust the vent cap assembly to attach the vent cap assembly to the vent pipe. In some embodiments, clips may be disposed on the straps along the inner diametrical surface formed by the straps, and the clips may be used to engage or grip the outer vent pipe diameter. These and other features will be described in detail below with reference to the drawings.

Turning now to the drawings, FIG. 1 illustrates a heating, ventilation, and air conditioning (HVAC) system for building environmental management that may employ an HVAC unit. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single packaged unit containing other equipment, such as a blower, integrated air handler, and/or auxiliary heating unit.

The HVAC unit 12 may be an air cooled device that provides conditioned air to the building 10. Specifically, the HVAC unit 12 may include heat exchanger coils across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may provide both heating and cooling to the building, such that the HVAC unit 12 operates in different modes.

A control device 16, one type of which may be a thermostat, may be used to designate the temperature of the conditioned air. The control device 16 also may be used to control the flow of air through the ductwork 14. For example, the control device 16 may be used to regulate operation of a component of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

In some embodiments, the HVAC unit 12 or a separate HVAC unit of the building 10 may include a furnace. The furnace may include a combustion chamber which combusts an air-fuel mixture to generate hot combustion gases. The hot combustion gases may be passed through a heat exchange coil, and a fan or blower may urge an air flow over the heat exchange coil. Accordingly, the air flow may extract heat from the hot combustion gases, and the hot combustion gases may be subsequently vented to environment. In accordance with present embodiments, a vent pipe may be utilized to vent the used combustion gases to the external environment. A vent cap assembly may be disposed on the vent pipe to enable venting of the combustion gases while blocking moisture/liquids, such as rain, debris, or other external elements from entering the pipe.

Figure 2:
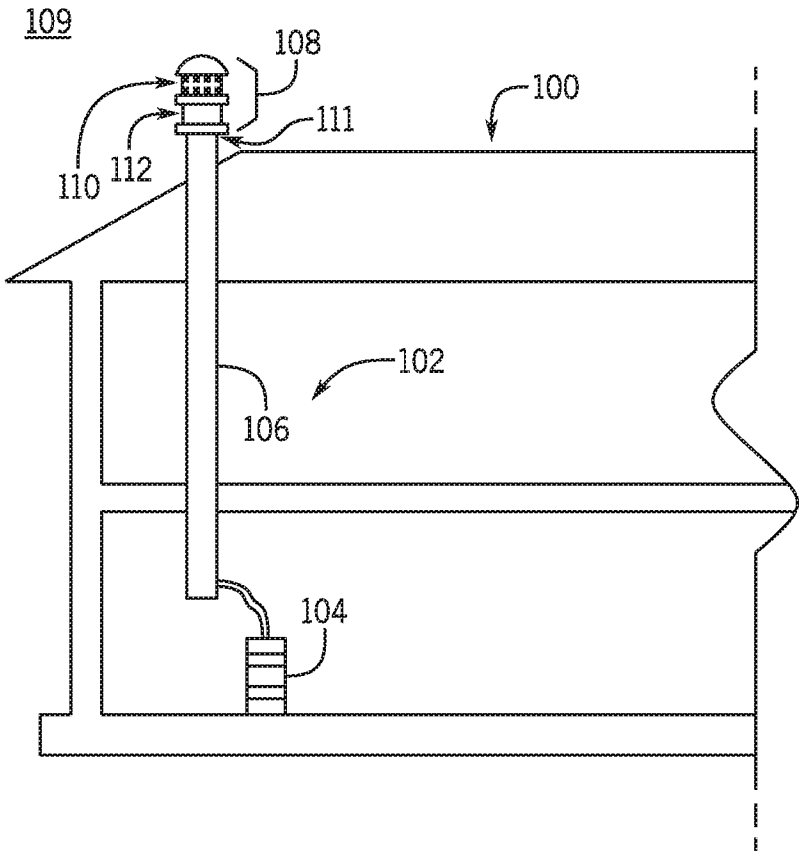
FIG. 2 is a cross-sectional front view of a furnace, a vent pipe, and a vent cap assembly for building environmental management, in accordance with embodiments described herein.

For example, FIG. 2 is a cross-sectional front view of an embodiment of a furnace 104, a vent pipe 106, and a vent cap assembly 108. The furnace 104 in the illustrated embodiment is disposed in an interior 102 of a structure 100. The furnace 104 may generate combustion gases, as described above, which are routed through the vent pipe 106 to an environment 109 external to the interior 102 of the structure 100. A vent cap assembly 108 in accordance with the present disclosure may be disposed on the end of the pipe 106, and may be configured to enable gases to pass from the pipe 106 into the environment 109, while blocking moisture/liquids, such as rain, or other external elements from entering the pipe 106.

The illustrated pipe 106 may include a particularly sized outer diameter at an end 111 of the pipe 106. In another furnace, a vent pipe may include a substantially different outer diameter, such as an outer diameter of a different size. Thus, in accordance with the present disclosure, the illustrated vent cap assembly 108 includes an adjustable neck 112 attached to a vent cap 110 of the vent cap assembly 108, whereby the adjustable neck 112 includes features which can be manipulated or adjusted to fit the vent cap assembly 108 onto differently sized pipes. That is, while the illustrated vent cap assembly 108 is attached to the illustrated vent pipe 106, the illustrated vent cap assembly 108 could be removed from the illustrated vent pipe 106, and the adjustable neck 112 may be adjusted to fit the vent cap assembly 108 onto a pipe having a differently sized outer diameter than the illustrated vent pipe 106. The adjustable neck 112 may be adjusted to enable a friction fit between the vent cap assembly 108 and the vent pipe 106. As will be appreciated in view of the description below with reference to later drawings, the adjustable neck 112 may utilize an adjustable strap system which enables the above-described effects.

Figure 5:
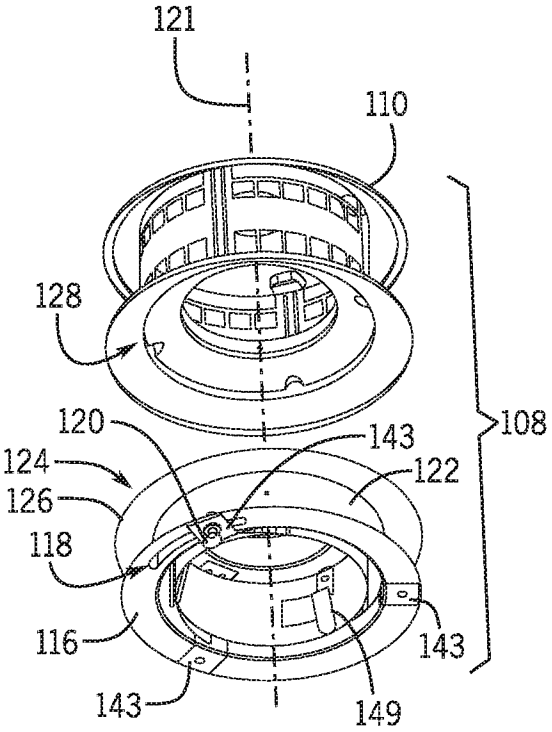
FIG. 5 is another exploded perspective view of the vent cap assembly of FIG. 3, in accordance with embodiments described herein.
Figure 4:
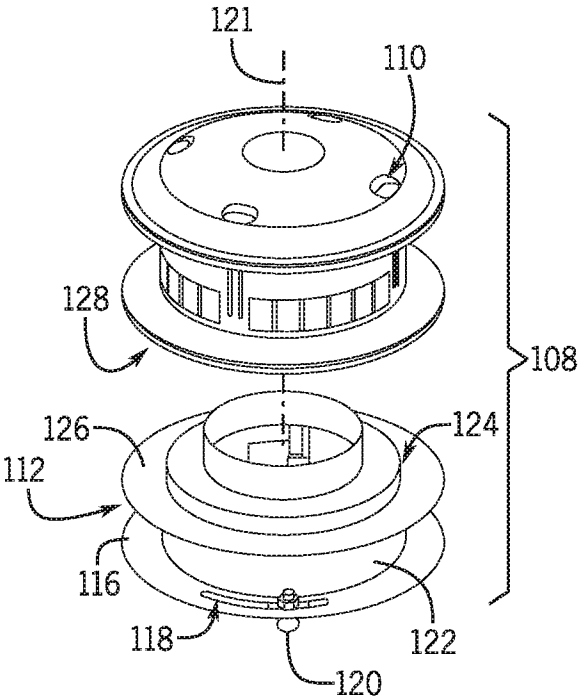
FIG. 4 is an exploded perspective view of the vent cap assembly of FIG. 3, in accordance with embodiments described herein.
Figure 3:
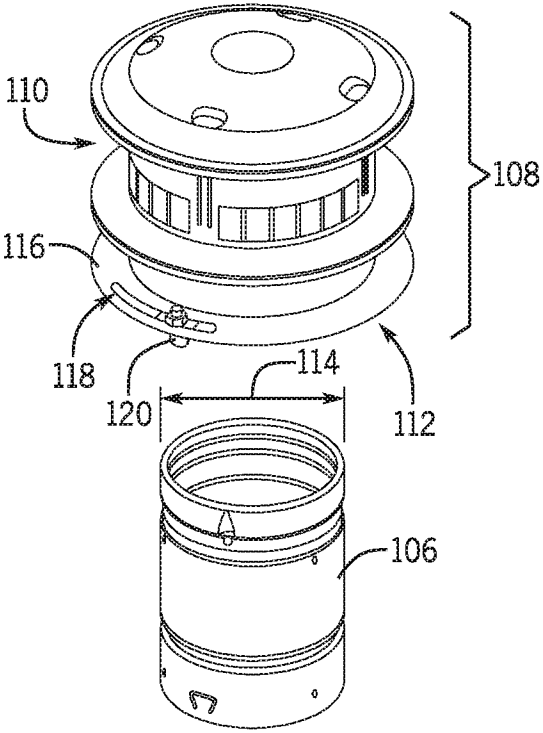
FIG. 3 is an exploded perspective view of the vent pipe and the vent cap assembly of FIG. 2, in accordance with embodiments described herein.

FIG. 3 is an exploded perspective view of an embodiment of the vent pipe 106 and the vent cap assembly 108 of FIG. 2. FIGS. 4 and 5 are exploded perspective views of an embodiment of the vent cap assembly 108 illustrated in FIG. 3. As previously described, the vent cap assembly 108 includes the vent cap 110 and the adjustable neck 112 coupled to the vent cap 110. Focusing in particular on FIG. 4, the adjustable neck 112 may include a mount 124 which couples to the vent cap 110, and a cylindrical body 122 which is disposed underneath the mount 124 and is freely rotatable with respect to the mount 124. A securement mechanism 120, which may directly or indirectly couple to the mount 124, extends through an arcuate slot 118 along a flange 116 of the cylindrical body 122. The securement mechanism 120 may include a nut and bolt, or some other securement assembly. The securement mechanism 120 can be tightened against the flange 116 of the cylindrical body 122 to block relative circumferential movement between the cylindrical body 122 and the mount 124, and can be loosened from the flange 116 of the cylindrical body 122 to enable relative circumferential movement between the cylindrical body 122 and the mount 124. When the securement mechanism 120 is loosened to enable the relative circumferential movement described above, for example about a central axis of the vent cap assembly 108, internal components (not shown), such as an adjustable strap system, may be adjusted to fit the vent cap assembly 108 onto a particular outer diameter 114 of a particular vent pipe 106.

Focusing on FIG. 5, the securement mechanism 120 may include a nut and bolt assembly which engages the above-described adjustable strap system, for example via one or more intervening components referred to as legs 143. In the illustrated embodiment, the securement mechanism 120 is coupled to one leg 143. The leg 143 coupled to the securement mechanism 120, and the other legs 143 illustrated in FIG. 5, may couple to the mount 124, which is otherwise detached from the cylindrical body 122 such that the cylindrical body 122 is freely rotatable about the central axis 121, relative to the mount 124, the legs 143, and the securement mechanism 120. The above-described adjustable strap system may also couple to an inner wall of the cylindrical body 122. Thus, as the cylindrical body 122 is turned relative to the mount 124, a portion of the adjustable strap system is held stationary via the legs 143, and another portion of the adjustable strap system is actuated along with the cylindrical body 122, thereby causing an adjustment to an inner diametrical surface formed by the strap system.

Continuing with FIG. 5, the mount 124 may be coupled to, or integral with, the vent cap 110. In some embodiments of the vent cap assembly 108, the mount 124 may be welded to the vent cap 110. For example, in the illustrated embodiment, the mount 124 includes a mounting flange 126 which may be welded to a mounting surface 128 of the vent cap 110. Thus, since the cylindrical body 122 may be freely rotatable relative to the mount 124, the cylindrical body 122 may also be freely rotatable relative to the vent cap 110. As suggested above and described in detail below with reference to FIGS. 6-10, the cylindrical body 122 of the adjustable neck 112 may house components, such as straps of the aforementioned adjustable strap system, that enable adjustability of the adjustable neck 112 to fit various vent pipes of different sizes.

Figure 6:
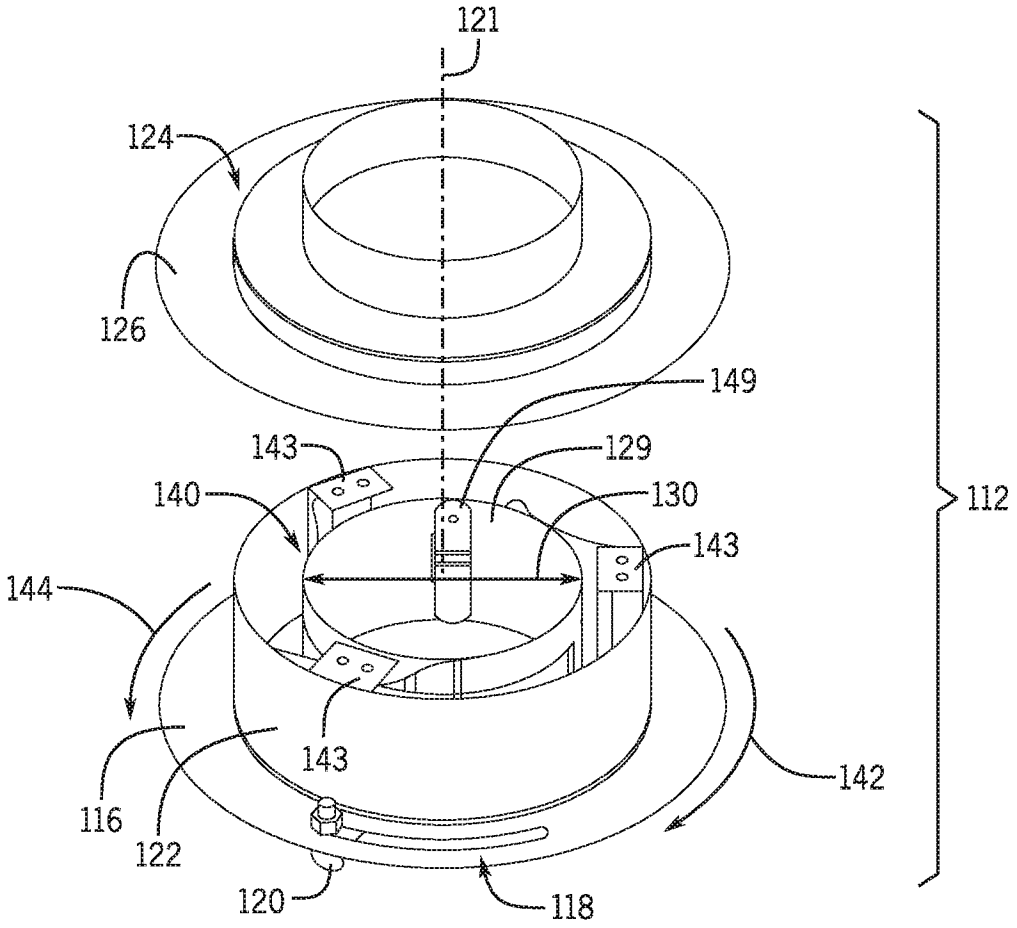
FIG. 6 is an exploded perspective view of an adjustable neck of the vent cap assembly of FIG. 3, in accordance with embodiments described herein.

For example, FIG. 6 is an exploded perspective view of an embodiment of the adjustable neck 112 of the vent cap assembly of FIG. 3. In the illustrated exploded view, the mount 124 is shown separate from the cylindrical body 122. A strap system 140 having three straps may be disposed within, or radially inward from, the cylindrical body 122. It should be noted that, in another embodiment, the strap system 140 may include two straps or more than three straps. The three straps of the illustrated strap system 140 may form an inner diametrical surface 129 having an adjustable diameter 130 or other identifying dimension, whereby the inner diametrical surface 129 is configured to engage an outer diameter of the vent pipe 106 illustrated in FIGS. 2 and 3.

The securement mechanism 120, which extends through the arcuate slot 118 of the flange 116 of the cylindrical body 122 of the adjustable neck 112, accesses and/or engages with at least one strap of the strap system 140, such as via an intervening leg 143. The other straps of the adjustable strap system 140 may also be coupled to legs 143. In other words, each strap of the adjustable strap system 140 includes a portion coupled to a corresponding leg 143. Each strap may also include a portion coupled to the cylindrical body 122. Each of the legs 143 may be coupled to, for example via welding, fasteners, or other suitable components, to the mount 124. The legs 143 may also be detached from, or not coupled to, the cylindrical body 122. As the cylindrical body 122 (sometimes referred to as an actuator) is moved, for example by an operator during an installation process, in a clockwise direction 142 about the central axis 121 of the adjustable neck 112 or corresponding vent cap assembly 108, the three straps of the strap system 140 are moved, for example via the portions coupled to the cylindrical body 122, thereby causing a diameter 130 of the inner diametrical surface 129 to increase. That is, the legs 143 hold portions of the straps stationary, and the cylindrical body 122 pulls portions of the straps along with the cylindrical body 122, causing the straps to form a different diameter 130 of the inner diametrical surface 129. The strap system 140 and corresponding features will be described in detail below with reference to FIGS. 7-10.

Figure 7:
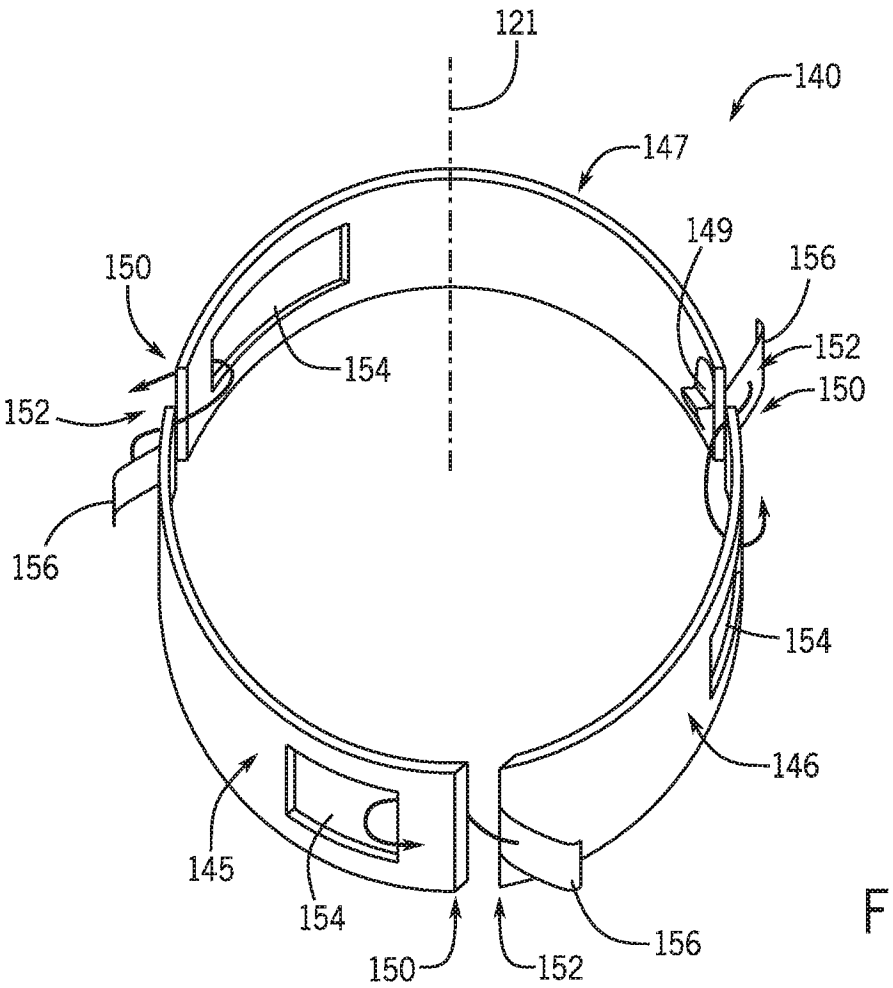
FIG. 7 is a perspective view of three adjustable straps for use in a strap system of the adjustable neck of FIG. 6, in accordance with embodiments described herein.

FIG. 7 is a front view of an embodiment of three adjustable straps 145, 146, 147 for use in the adjustable neck 112 of FIG. 6. The three adjustable straps 145, 146, 147, when joined, form the aforementioned adjustable strap system 140. As previously described, other embodiments of the strap system 140 may include two straps or more than three straps. In the illustrated embodiment, each strap 145, 146, 147 includes a window end 150 and a hook end 152. An opening, referred to by the present disclosure as a window 154, is disposed in each strap 145, 146, 147 proximate to the window end 150 of each strap 145, 146, 147. In some embodiments, the window 154 may extend toward a respective midsection of the corresponding strap 145, 146, 147. Further, in certain embodiments, the window 154 may be spaced from the tip of the window end 150 more than in the illustrated embodiment. The illustrated embodiment is schematic and for purposes of facilitating description.

A hook 156 is disposed on each strap 145, 146, 147 proximate to the hook end 152 of each strap 145, 146, 147. The hook 156 may include the same material as the base material of the corresponding strap 145, 146, 147, and may be integrally formed with the corresponding strap 145, 146, 147. Although not shown in the illustrated embodiment, an inner surface of the cylindrical body 122 of the adjustable neck 112 may be coupled to ends of the hooks 156, which may ground the hooks 156 to positions along the inner surface of the cylindrical body 122.

Further, as shown in the illustrated embodiment, the hook 156 of strap 145 is configured to engage, or extend through, the window 154 of adjacent strap 147. Further, the hook 156 of strap 147 (not shown due to illustrated perspective) is configured to engage, or extend through, the window 154 of adjacent strap 146. Further still, the hook 156 of strap 146 is configured to engage, or extend through, the window 154 of adjacent strap 145. Each strap 145, 146, 147 is made of a flexible material which can be curved to form an arcuate segment of a loop, as shown. Thus, the three straps 145, 146, 147 in the illustrated embodiment may be curved and joined end-to-end or "hook-to-window" to form a closed loop having an inner diametrical surface. When the straps 145, 146, 147 are joined as described above, the strap system 140 can be controlled to adjust a dimension of the inner diametrical surface formed by the joined straps 145. These features will be described in detail below with reference to FIGS. 8-10.

FIGS. 8A-8C are perspective views illustrating an embodiment of the strap system 140, utilizing the adjustable straps 145, 146, 147 of FIG. 7, disposed in three different positions. Specifically, FIG. 8A illustrates a tight position 157 of the strap system 140, FIG. 8B illustrates a medium position 158 of the strap system 140, and FIG. 8C illustrates a loose position 159 of the strap system 140. The terms "tight," "medium," and "loose" are relative terms utilized merely to differentiate between the three illustrated positions 157, 158, 159 of the strap system 140. It should be understood that the illustrated positions 157, 158, 159 are non-limiting and utilized in the present disclosure for discussion purposes, and that the strap system 140 can be adjusted to a number of different sizes.

Thus, FIGS. 8A-8C include an assembly of the straps 145, 146, 147 forming the strap system 140 referenced above with respect to FIG. 7, illustrated in the three different positions 157, 158, 159 to demonstrate the adjustability of the assembled strap system 140. As shown, to achieve the tight position 157 of FIG. 8A, the hook ends 152 of the straps 145, 146, 147 are moved in the counterclockwise direction 144 until the window 154 of each strap 145, 146, 147 is fully overlapped or occluded by the adjacent strap 145, 146, 147. For example, in the illustrated tight position 157, the window 154 of strap 146 is fully overlapped by adjacent strap 145, which is exposed (or shown through) the window 154 of strap 146 and includes the hook 156 of adjacent strap 145 extending through the window 154 of strap 146. As previously described, the hooks 156 of the straps 145, 146, 147 may be coupled to a position along an inner surface of a wall of the cylindrical body 122 of the adjustable neck 112, which facilitates movement of the hooks 156 as the cylindrical body 122 is moved. Additionally, the window ends 150 are coupled to a mount via intervening legs, whereby the mount is held stationary relative to the cylindrical body 122. Thus, as the hooks 156 of the hook ends 152 are moved away from the corresponding grounded window ends 150, the straps 145, 146, 147 and corresponding curvatures are tightened and move toward the central axis 121. As the hooks 156 of the hook ends 152 are moved toward the corresponding grounded window ends 150, the straps 145, 146, 147 and corresponding curvatures are loosened and move away from the central axis 121. An extent of overlap of the straps 145, 146, 147 relative to one another decreases as the straps 145, 146, 147 move away from the central axis 12, as illustrated in the loose position 159 of FIG. 8C. Conversely, an extent of overlap of the straps 145, 146, 147 relative to one another increases as the straps 145, 146, 147 move toward the central axis 121, as illustrated in the tight position 157 of FIG. 8A. It should be noted that clips 149 may be disposed along the inner diametrical surface 129 proximate to the hook ends 152 having the hooks 156. The clips 149 may operate to grip an outer pipe diameter. That is, the clips 149 may include an S-shape, or similar shape, and a lip or ridge along the outer pipe diameter may slip toward an upper portion of the clips 149, such that the clips 149 grip the pipe.

Figure 9A:
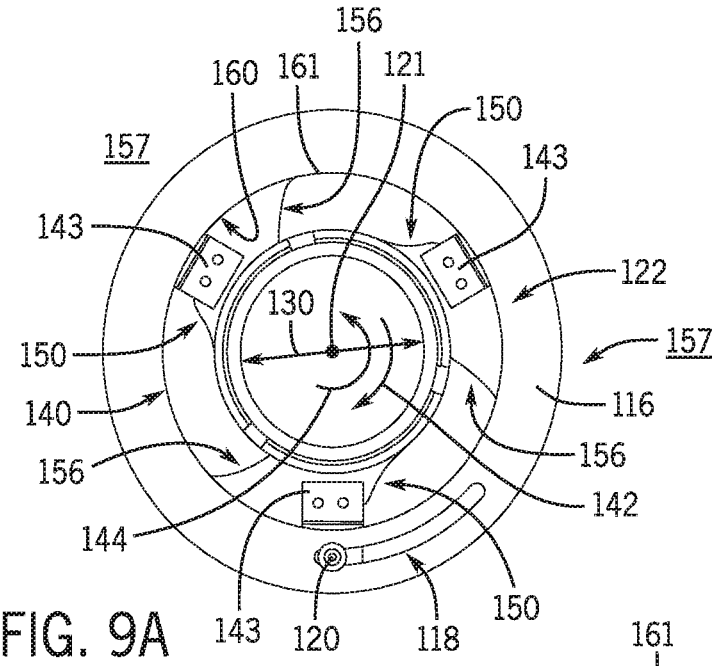
FIGS. 9A-9C are top views illustrating an embodiment of a portion of the adjustable neck of FIG. 6 having the strap system of FIG. 8 disposed in the three positions illustrated in FIG. 8, in accordance with embodiments described herein.
Figure 9B:
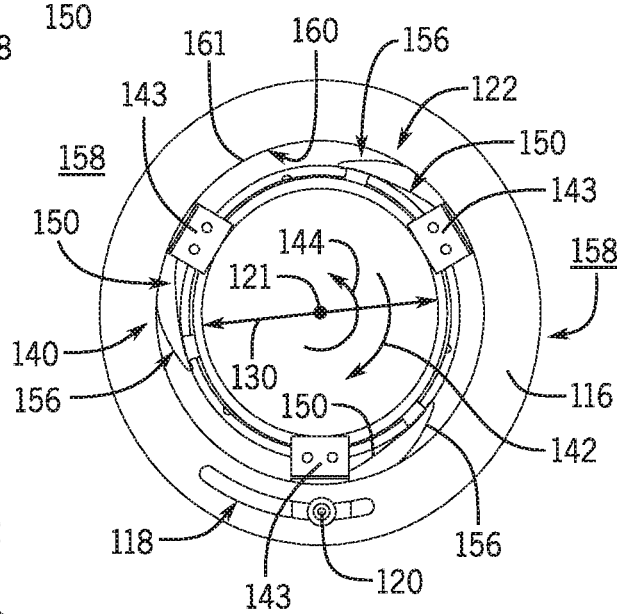
Figure 9C:
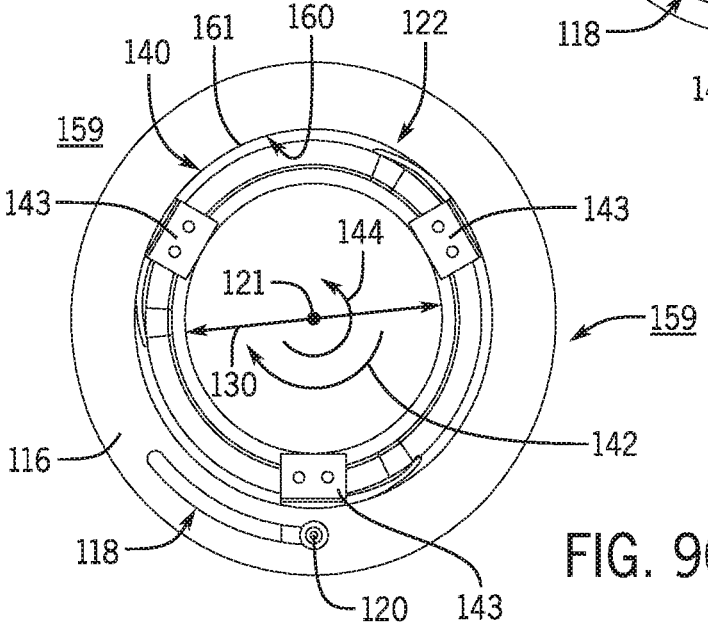
Figure 10A:
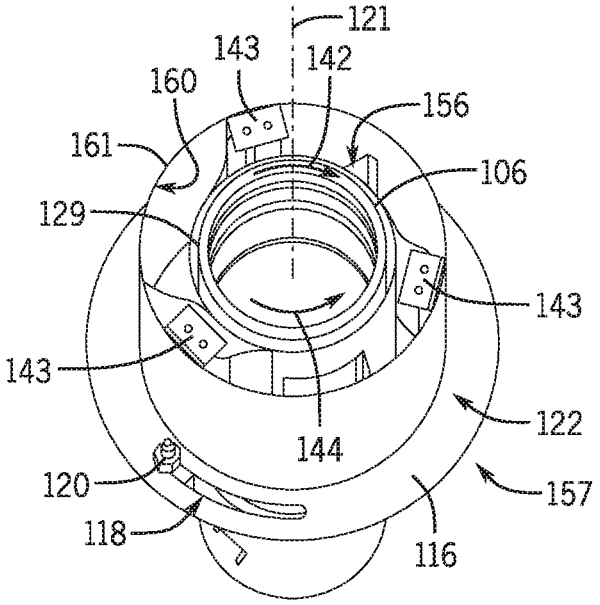
FIG. 10A-10C are perspective views illustrating an embodiment of a portion of the adjustable neck of FIG. 6 having the strap system of FIG. 8 disposed in the three positions illustrated in FIG. 8, in accordance with embodiments described herein.
Figure 10B:
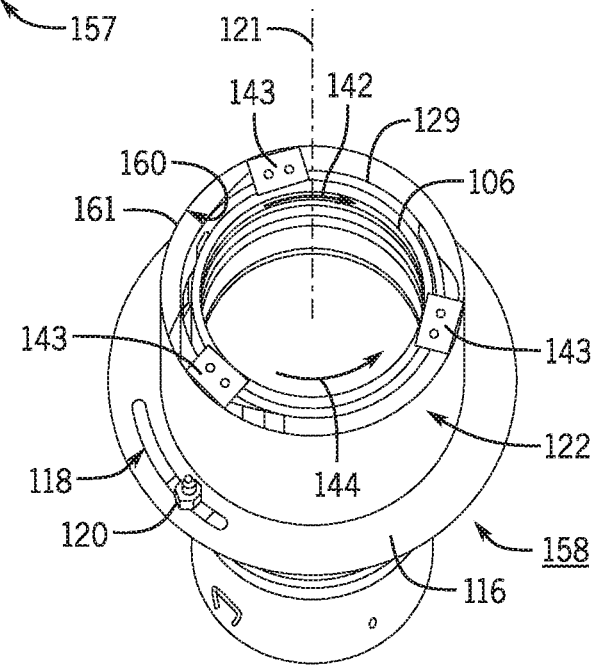
Figure 10C:
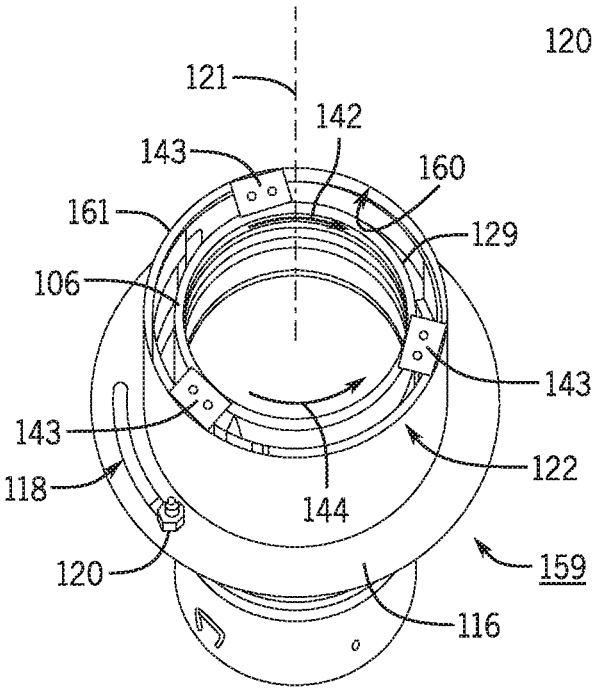

FIGS. 9A-9C are top views illustrating an embodiment of the vent cap assembly 108 of FIG. 3 having the strap system 140 disposed in the three positions 157, 158, 159 illustrated in FIGS. 8A-8C. FIGS. 10A-10C are perspective views illustrating an embodiment of the vent cap assembly of FIG. 3 having the strap system disposed in the three positions illustrated in FIGS. 8A-8C. That is, the tight position 157 of the strap system 140 is illustrated in FIGS. 8A, 9A, and 10A, the medium position 158 of the strap system 140 is illustrated in FIGS. 8B, 9B, and 10B, and the loose position 159 of the strap system 140 of the strap system 140 is illustrated in FIGS. 8C, 9C, and 10C.

As previously described, and as best illustrated in the tight position 157 of FIG. 9A, the hooks 156 of the straps 145, 146, 147 may be coupled to an inner surface 160 of a wall 161 of the cylindrical body 122 of the adjustable neck 112. The window ends 150 may be coupled to the legs 143. As previously described, the legs 143 are detached from the cylindrical body 122, and may be rooted to a mount (not shown). Thus, as the cylindrical body 122 is turned relative to the legs 143, the inner surface 160 of the wall 161 of the cylindrical body 122 moves the hooks 156 while the legs 143 remain stationary. As previously described, the securement mechanism 120 may be coupled to one of the legs 143. The securement mechanism 120 may be tightened against the flange 116 of the cylindrical body 122 to prevent actuation, and may be loosened from the flange 116 of the cylindrical body 122 to prevent actuation. That is, when the securement mechanism 120 is in the loosened condition, the cylindrical body 122 can be turned to actuate the strap system, as previously described, while a relative position of the securement mechanism 120 within the arcuate slot 118 is changed. After actuation, the securement mechanism 120 may be tightened against the flange 116 to block further movement or actuation. For example, to move from the tight position 157 of FIG. 9A to the middle position 158 of FIG. 9B, the cylindrical body 122 may be rotated in the clockwise direction 142, thereby causing the a relative change to a position of the securement mechanism 120 within the slot 118, and thereby causing the hooks 156 to rotate in the clockwise direction 142, with the cylindrical body 122, as the legs 143 and the window ends 150 are held stationary (for example by the mount). To move from the loose position 159 of FIG. 9C to the middle position 158 of FIG. 9B, the cylindrical body 122 is moved in the counterclockwise direction 144, thereby causing a relative change to a position of the securement mechanism 120 within the slot 118, and thereby causing the hooks 156 to rotate in the counterclockwise direction 144, with the cylindrical body 122, as the legs 143 and the window ends 150 are held stationary (for example by the mount).

As shown in FIGS. 10A-10C, the above-described movement may enable adjustment of a dimension, such as a diameter, of the inner diametrical surface 129 to fit differently sized pipes 106. For example, FIGS. 10A-10C illustrate the tight position 157, the middle position 158, and the loose position 159, although a number of various positions are possible, as previously described. As shown, when the cylindrical body 122 is moved in the clockwise direction 142, the curved surfaces of the straps move away from the central axis 121. Thus, as the cylindrical body 122 is moved further and further in the clockwise direction 142, as illustrated from FIG. 10A to FIG. 10B to FIG. 10C, the straps are adjusted to fit a larger sized vent pipe, enabling the straps to conform to the diameter of the vent pipe it is positioned over. In doing so, an operator can manually move the cylindrical body 122 to cause an engagement, such as a friction fit, between the straps and the vent pipe. The operator can tighten the securement mechanism 120 after adjustment and attachment to the vent pipe, as previously described, which maintains the above-described friction fit.

It should be noted that the above-described reference to clockwise and counterclockwise directions, and how actuation in the clockwise and counterclockwise directions causes changes to a size for a pipe fitting, is intended for exemplary purposes only. That is, depending on the embodiment, the parts may be arranged such that clockwise actuation causes a reduction in a size of a surface configured to engage a pipe, or such that clockwise actuation causes an increase in the size of the surface configured to engage the pipe.

In accordance with the present disclosure, a vent cap assembly includes a vent cap and an adjustable neck coupled to the vent cap, where the adjustable neck includes a strap system forming an adjustable inner diametrical surface configured to be adjusted to fit differently sized pipes. In doing so, the vent cap assembly can be attached to differently sized pipes via a simple, cost effective installation process. Further, the adjustability features reduce manufacturing costs because a single design of vent cap assembly can be manufactured to fit different sized pipes, instead of manufacturing multiple different types of vent caps.

While only certain features and embodiments of the disclosure have been illustrated and described, many modifications and changes may occur to those skilled in the art, such as variations in sizes, dimensions, structures, shapes and proportions of the various elements, values of parameters including temperatures and pressures, mounting arrangements, use of materials, colors, orientations, etc., without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. An adjustable neck for a vent cap, comprising:

a housing having a mount and a cylindrical body having an inner surface;

a plurality of adjustable straps arranged to form an adjustable inner diametrical surface disposed radially inward from the cylindrical body of the housing, relative to a central axis of the adjustable neck, wherein the adjustable inner diametrical surface is configured to engage an outer pipe surface, and wherein the plurality of adjustable straps is coupled to the inner surface of the cylindrical body; and a plurality of legs coupled to the plurality of adjustable straps and to the mount, wherein the cylindrical body is configured to be rotated relative to the mount and the plurality of legs coupled to the mount to adjust a dimension of the adjustable inner diametrical surface to correspond to the outer pipe surface.

2. The adjustable neck of claim 1, comprising a securement mechanism coupled to the plurality of legs, wherein a loosened position of the securement mechanism is configured to enable rotation of the cylindrical body relative to the mount, and wherein a tightened position of the securement mechanism is configured to block rotation of the cylindrical body relative to the mount.

3. The adjustable neck of claim 2, wherein the cylindrical body comprises a portion having a slot through which the securement mechanism extends, and wherein the tightened position of the securement mechanism is configured to engage the securement mechanism against the portion of the cylindrical body to block rotation of the cylindrical body relative to the mount.

4. The adjustable neck of claim 3, wherein the portion comprises a flange extending from the cylindrical body, and wherein the slot is disposed along the flange.

5. The adjustable neck of claim 3, wherein the slot comprises an arcuate slot, and wherein a curvature of the arcuate slot is substantially concentric with a strap curvature of the adjustable inner diametrical surface.

6. The adjustable neck of claim 1, wherein each adjustable strap of the plurality of adjustable straps comprises a window end, a hook end opposite the window end, a window formed in the adjustable strap adjacent to the window end, and a hook extending from or adjacent to the hook end.

7. The adjustable neck of claim 6, wherein each leg of the plurality of legs is coupled to a corresponding window end of a corresponding adjustable strap of the plurality of adjustable straps.

8. The adjustable neck of claim 6, wherein each hook end of the plurality of adjustable straps is coupled to the inner surface of the cylindrical body.

9. The adjustable neck of claim 1, wherein the plurality of adjustable straps comprises:

a first adjustable strap having a first window end, a first hook end opposite the first window end, a first window formed in the first adjustable strap adjacent to the first window end, and a first hook extending from or adjacent to the first hook end;

a second adjustable strap having a second window end, a second hook end opposite the second window end, a second window formed in the second adjustable strap adjacent to the second window end, and a second hook extending from or adjacent to the second hook end; and a third adjustable strap having a third window end, a third hook end opposite the third window end, a third window formed in the third adjustable strap adjacent to the third window end, and a third hook extending from or adjacent to the third hook end, wherein the first window of the first adjustable strap is configured to receive the second hook of the second adjustable strap, and wherein the second window of the second adjustable strap is configured to receive the third hook of the third adjustable strap.

10. The adjustable neck of claim 9, wherein the third window of the third adjustable strap is configured to receive the first hook of the first adjustable strap.

11. The adjustable neck of claim 1, wherein the cylindrical body is configured to be actuated in a first circumferential direction to decrease the dimension of the adjustable inner diametrical surface, and wherein the cylindrical body is configured to be actuated in a second circumferential direction opposite to the first circumferential direction to increase the dimension of the adjustable inner diametrical surface.

12. The adjustable neck of claim 1, wherein the housing is configured to be coupled to the outer pipe surface via a friction fit between the outer pipe surface and the adjustable inner diametrical surface formed by the plurality of adjustable straps.

13. The adjustable neck of claim 1, wherein the mount is configured to be welded to the vent cap.

14. A vent cap assembly configured to couple to an outer pipe surface, comprising:

a vent cap; and a rotary adjustable neck, wherein the rotary adjustable neck comprises a mount coupled to the vent cap, a cylindrical body rotatable relative to the mount, a plurality of adjustable straps arranged within the cylindrical body to form an adjustable inner diametrical surface configured to engage the outer pipe surface to couple the vent cap assembly thereto, and a plurality of legs arranged within the cylindrical body and coupled to the mount and to the plurality of adjustable straps, wherein the cylindrical body is configured to be rotated in a circumferential direction about a lonigtudinal axis of the rotary adjustable neck to adjust a dimension of the adjustable inner diametrical surface such that the dimension corresponds to the outer pipe surface.

15. The vent cap assembly of claim 14, wherein the plurality of adjustable straps is coupled to a surface of the cylindrical body.

16. The vent cap assembly of claim 14, wherein cylindrical body is configured to rotate relative to the plurality of legs as the cylindrical body is rotated in the circumferential direction.

17. The vent cap assembly of claim 16, comprising a securement mechanism coupled to at least one leg of the plurality of legs, where the securement mechanism is configured to be tightened against a portion of the cylindrical body to block relative rotation of the cylindrical body and the mount.

18. The vent cap assembly of claim 17, wherein the cylindrical body comprises a slot through which the securement mechanism extends, and wherein a position of the securement mechanism is configured to be moved within the slot as the cylindrical body is rotated in the circumferential direction.

19. The vent cap assembly of claim 14, wherein the plurality of adjustable straps comprises:

a first strap having a first window end proximate which a first window is disposed, and having a first hook end proximate which a first hook is disposed;

a second strap having a second window end proximate which a second window is disposed, and having a second hook end proximate which a second hook is disposed, wherein the second hook of the second strap is configured to engage with the first strap at the first window; and a third strap having a third window end proximate which a third window is disposed, and having a third hook end proximate which a third hook is disposed, wherein the third hook of the third strap is configured to engage the second strap at the second window, and wherein the first hook of the first strap is configured to engage the third strap at the third window.

20. The vent cap assembly of claim 19, wherein a first leg of the plurality of legs is coupled to the first strap, wherein a second leg of the plurality of legs is coupled to the second strap, and wherein a third leg of the plurality of legs is coupled to the third strap.

21. An adjustable neck for a vent cap, comprising:

a housing having a cylindrical body having a surface;

an adjustable strap system disposed within the housing and comprising a first adjustable strap coupled to the surface of the cylindrical body, a second adjustable strap coupled to the surface of the cylindrical body, and a third adjustable strap coupled to the surface of the cylindrical body, wherein the first adjustable strap, the second adjustable strap, and the third adjustable strap are joined to form an adjustable inner diametrical surface; and a first leg coupled to the first adjustable strap, a second leg coupled to the second adjustable strap, and a third leg coupled to the third adjustable strap, wherein movement of the cylindrical body in a first circumferential direction relative to the first leg, the second leg, and the third leg causes a dimension of the adjustable inner diametrical surface formed by the adjustable strap system to increase, and wherein movement of the cylindrical body in a second circumferential direction opposite to the first circumferential direction relative to the first leg, the second leg, and the third leg causes the dimension of the adjustable inner diametrical surface formed by the adjustable strap system to decrease.

22. The adjustable neck of claim 21, wherein the first adjustable strap comprises a first window end proximate which a first window is disposed, and comprises a first hook end proximate which a first hook is disposed, wherein the second adjustable strap comprises a second window end proximate which a second window is disposed, and comprises a second hook end proximate which a second hook is disposed, wherein the second hook of the second adjustable strap is configured to engage with the first adjustable strap at the first window, wherein the third adjustable strap comprises a third window end proximate which a third window is disposed, and comprises a third hook end proximate which a third hook is disposed, wherein the third hook of the third adjustable strap is configured to engage the second adjustable strap at the second window, and wherein the first hook of the first adjustable strap is configured to engage the third adjustable strap at the third window.

23. The adjustable neck of claim 22, wherein the housing comprises a mount, wherein the cylindrical body is rotatable relative to the mount, and the mount is coupled to the first leg, the second leg, and the third leg.

24. The adjustable neck of claim 21, comprising a securement mechanism coupled to the first leg and configured to be tightened against a portion of the cylindrical body to block movement of the cylindrical body in the first circumferential direction and the second circumferential direction.

* * * * *